US011724363B2

(12) United States Patent
Nienaber et al.

(10) Patent No.: US 11,724,363 B2
(45) Date of Patent: Aug. 15, 2023

(54) METHOD OF MAKING A COATED ABRASIVE ARTICLE

(71) Applicant: 3M INNOVATIVE PROPERTIES COMPANY, St. Paul, MN (US)

(72) Inventors: Aaron K. Nienaber, Maplewood, MN (US); Joseph B. Eckel, Vadnais Heights, MN (US); Thomas J. Nelson, Woodbury, MN (US); Ronald D. Jesme, Plymouth, MN (US); Jaime A. Martinez, Woodbury, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 534 days.

(21) Appl. No.: 17/049,470

(22) PCT Filed: Apr. 16, 2019

(86) PCT No.: PCT/IB2019/053143
§ 371 (c)(1),
(2) Date: Oct. 21, 2020

(87) PCT Pub. No.: WO2019/207415
PCT Pub. Date: Oct. 31, 2019

(65) Prior Publication Data

US 2021/0237229 A1 Aug. 5, 2021

Related U.S. Application Data

(60) Provisional application No. 62/703,512, filed on Jul. 26, 2018, provisional application No. 62/661,750, filed on Apr. 24, 2018.

(51) Int. Cl.

| | |
|---|---|
| ***B24D 11/00*** | (2006.01) |
| ***B24D 3/28*** | (2006.01) |
| ***B24D 18/00*** | (2006.01) |

(52) U.S. Cl.
CPC ..... *B24D 11/005* (2013.01); *B24D 3/28* (2013.01); *B24D 18/0072* (2013.01)

(58) Field of Classification Search
CPC ..... B24D 11/005; B24D 3/28; B24D 18/0072
(Continued)

(56) References Cited

U.S. PATENT DOCUMENTS 2,033,991 A 3/1936 Melton
2,857,879 A * 10/1958 Johnson ..... B24D 11/005 427/195

(Continued)

FOREIGN PATENT DOCUMENTS

CN 104999385 A 10/2015
CN 106753243 A 5/2017

(Continued)

OTHER PUBLICATIONS

Barbee, "Microstructure of Amorphous 304 Stainless steel-carbon alloys synthesized by magnetron sputter deposition", Thin Solid Films, 1979, vol. 63, pp. 143-150.

(Continued)

*Primary Examiner* — James E McDonough
(74) *Attorney, Agent, or Firm* — Bradford B. Wright

(57) ABSTRACT

A method of making a coated abrasive article includes at least four steps. In step a), a web is provided comprising a backing having a make layer precursor disposed thereon. The web moves along a web path in a downweb direction, and the web has a crossweb direction that is perpendicular to the downweb direction. The make layer precursor comprises a first curable binder precursor; In step b) an applied magnetic field is provided. In step c), a mixture of magnetizable non-magnetizable particles is passed through the applied magnetic field and onto the make layer precursor such that the magnetizable and non-magnetizable particles (Continued)

are predominantly deposited onto the web in a drop zone according to a predetermined order. At least one of the magnetizable particles or the non-magnetizable particles comprises abrasive particles. In step d), the make layer precursor is at least partially cured to provide a make layer.

15 Claims, 1 Drawing Sheet

(58) Field of Classification Search
USPC ..... 51/293, 298
See application file for complete search history.

(56) References Cited

U.S. PATENT DOCUMENTS

| | | | |
|---|---|---|---|
| 3,041,156 | A | 6/1962 | Rowse |
| 4,314,827 | A | 2/1982 | Leitheiser |
| 1,910,444 | A | 5/1983 | Nicholson |
| 4,518,397 | A | 5/1985 | Leitheiser |
| 4,612,242 | A | 9/1986 | Vesley |
| 4,623,364 | A | 11/1986 | Cottringer |
| 4,652,275 | A | 3/1987 | Bloecher |
| 4,734,104 | A | 3/1988 | Berg |
| 4,737,163 | A | 4/1988 | Larkey |
| 4,744,802 | A | 5/1988 | Schwabel |
| 4,770,671 | A | 9/1988 | Monroe |
| 4,799,939 | A | 1/1989 | Bloecher |
| 4,881,951 | A | 11/1989 | Wood |
| 4,927,431 | A | 5/1990 | Buchanan |
| 4,997,461 | A | 3/1991 | Markhoff-Matheny |
| 5,009,675 | A | 4/1991 | Kunz |
| 5,011,508 | A | 4/1991 | Wald |
| 5,042,991 | A | 8/1991 | Kunz |
| 5,078,753 | A | 1/1992 | Broberg |
| 5,085,671 | A | 2/1992 | Martin |
| 5,090,968 | A | 2/1992 | Pellow |
| 5,108,463 | A | 4/1992 | Buchanan |
| 5,137,542 | A | 8/1992 | Buchanan |
| 5,139,978 | A | 8/1992 | Wood |
| 5,152,917 | A | 10/1992 | Pieper |
| 5,201,916 | A | 4/1993 | Berg |
| 5,203,884 | A | 4/1993 | Buchanan |
| 5,213,590 | A | 5/1993 | Neff |
| 5,213,591 | A | 5/1993 | Celikkaya |
| 5,227,104 | A | 7/1993 | Bauer |
| 5,328,716 | A | 7/1994 | Buchanan |
| 5,352,254 | A | 10/1994 | Celikkaya |
| 5,366,523 | A | 11/1994 | Rowenhorst |
| 5,417,726 | A | 5/1995 | Stout |
| 5,435,816 | A | 7/1995 | Spurgeon |
| 5,498,269 | A | 3/1996 | Larmie |
| 5,505,747 | A | 4/1996 | Chesley |
| 5,560,753 | A | 10/1996 | Buchanan |
| 5,565,011 | A | 10/1996 | Follett |
| 5,573,619 | A | 11/1996 | Benedict |
| RE35,570 | E | 7/1997 | Rowenhorst |
| 5,672,097 | A | 9/1997 | Hoopman |
| 5,700,302 | A | 12/1997 | Stoetzel |
| 5,946,991 | A | 9/1999 | Hoopman |
| 5,975,987 | A | 11/1999 | Hoopman |
| 5,984,988 | A | 11/1999 | Berg |
| 6,129,540 | A | 10/2000 | Hoopman |
| 6,843,815 | B1 | 1/2005 | Thurber |
| 7,727,931 | B2 | 6/2010 | Brey |
| 8,034,137 | B2 | 10/2011 | Erickson |
| 8,142,531 | B2 | 3/2012 | Adefris |
| 8,142,532 | B2 | 3/2012 | Erickson |
| 8,142,891 | B2 | 3/2012 | Culler |
| 8,551,577 | B2 | 10/2013 | Moren |
| 8,698,394 | B2 | 4/2014 | McCutcheon |
| 2009/0165394 | A1 | 7/2009 | Culler |
| 2009/0169816 | A1 | 7/2009 | Erickson |
| 2012/0227333 | A1 | 9/2012 | Adefris |
| 2012/0231711 | A1* | 9/2012 | Keipert ..... C09K 3/1409 51/295 |
| 2013/0040537 | A1 | 2/2013 | Schwabel |
| 2013/0125477 | A1 | 5/2013 | Adefris |
| 2013/0312337 | A1* | 11/2013 | Moren ..... B05B 5/14 118/621 |
| 2013/0344786 | A1 | 12/2013 | Keipert |
| 2014/0290147 | A1 | 10/2014 | Seth |
| 2016/0221153 | A1 | 8/2016 | Rizzo, Jr. |
| 2017/0225298 | A1 | 8/2017 | Goers |
| 2018/0029194 | A1* | 2/2018 | Keipert ..... B24D 11/001 |
| 2021/0237229 | A1 | 8/2021 | Nienaber et al. |

FOREIGN PATENT DOCUMENTS

| | | |
|---|---|---|
| WO | WO 00/64588 | 11/2000 |
| WO | WO 2011/139562 | 11/2011 |
| WO | WO 2014/176108 | 10/2014 |
| WO | WO 2015/100220 | 7/2015 |
| WO | WO 2018/080703 | 5/2018 |
| WO | WO 2018/080704 | 5/2018 |
| WO | WO 2018/080705 | 5/2018 |
| WO | WO 2018/080755 | 5/2018 |
| WO | WO 2018/080756 | 5/2018 |
| WO | WO 2018/080784 | 5/2018 |
| WO | WO 2018/080799 | 5/2018 |
| WO | WO 2018/134732 | 7/2018 |
| WO | WO 2018/136268 | 7/2018 |
| WO | WO 2018/136269 | 7/2018 |
| WO | WO 2018/136271 | 7/2018 |
| WO | WO 2019/207416 | 10/2019 |
| WO | WO 2019/207417 | 10/2019 |

OTHER PUBLICATIONS

International Search Report for PCT International Application No. PCT/IB2019/053143, dated Jul. 29, 2019, 5 pages.

* cited by examiner

METHOD OF MAKING A COATED ABRASIVE ARTICLE

TECHNICAL FIELD

The present disclosure broadly relates to methods of making coated abrasive articles.

BACKGROUND

Coated abrasive articles are conventionally made by coating abrasive particles onto a make layer precursor disposed on a backing. The make precursor layer is then at least partially cured to form a make layer where the abrasive particles are bound to the backing by the make layer. A size layer precursor is disposed on the make layer and abrasive particles, and the size layer precursor is cured. Optionally, but commonly, a supersize layer (which may contain, grinding aids, lubricants, etc.) is disposed on the size layer. The make and size layers generally include a thermosetting resin (e.g., phenolic resin, aminoplast resin, curable acrylic resin, cyanate resin, and combinations thereof).

In some cases, two types of abrasive particles (or abrasive particles and grinding aid or filler particles) are used. They may be coated as a mixture or sequentially, which may give different results. Accordingly, abrasive particles are typically coated first, or in the case that two types of abrasive particles are coated, then the larger abrasive particles are often coated first. Sequential coating often gives different results than simultaneous coating of a particle blend; however, if the abrasive particles are coated in two steps, additional particle coating apparatus is required.

SUMMARY

It would be desirable to have a way to be able to sequentially coat two types abrasive particles without the need for two particle coating apparatuses.

Advantageously, the present disclosure provides methods for sequential coating of abrasive particles that use but a single particle coating apparatus to separately, but simultaneously coating two types/sizes of abrasive particles.

Accordingly, in one aspect, the present disclosure provides a method of making a coated abrasive article, the method comprising:

a) providing a web comprising backing having a make layer precursor disposed thereon, wherein the web moves along a web path in a downweb direction, wherein the web has a crossweb direction that is perpendicular to the downweb direction, and wherein the make layer precursor comprises a first curable binder precursor;

b) providing an applied magnetic field;

c) passing a mixture of magnetizable particles and non-magnetizable particles through at least a portion of the applied magnetic field and onto the make layer precursor such that the magnetizable particles and the non-magnetizable particles are predominantly deposited onto the web in a drop zone according to a predetermined order, wherein at least one of the magnetizable particles or the non-magnetizable particles comprises abrasive particles; and d) at least partially curing the make layer precursor to provide a make layer.

Steps a) and b) may be carried out in any order (e.g., a) then b), or b) then a)). Step d) is typically carried out after step c).

In some preferred embodiments, the applied magnetic field is provided by a rotating magnet having a rotational axis that is substantially parallel to the crossweb direction of at least a portion of the web path within the drop zone.

As used herein:

The term "crushed abrasive particle" refers to an abrasive particle that is formed through a mechanical fracturing process, and specifically excludes abrasive particles that are evidently formed into shaped abrasive particles by a molding operation and then fractured. The material fractured to produce the crushed abrasive particle may be in the form of bulk abrasive or an abrasive precursor. It may also be in the form of an extruded rod or other profile or an extruded or otherwise formed sheet of abrasive or abrasive precursor. Mechanical fracturing includes for example roll or jaw crushing as well as fracture by explosive comminution.

The term "ferrimagnetic" refers to materials that exhibit ferrimagnetism. Ferrimagnetism is a type of permanent magnetism that occurs in solids in which the magnetic fields associated with individual atoms spontaneously align themselves, some parallel, or in the same direction (as in ferromagnetism) and others generally antiparallel, or paired off in opposite directions (as in antiferromagnetism). The magnetic behavior of single crystals of ferrimagnetic materials may be attributed to the parallel alignment: the diluting effect of those atoms in the antiparallel arrangement keeps the magnetic strength of these materials generally less than that of purely ferromagnetic solids such as metallic iron Ferrimagnetism occurs chiefly in magnetic oxides known as ferrites. The spontaneous alignment that produces ferrimagnetism is entirely disrupted above a temperature called the Curie point, characteristic of each ferrimagnetic material. When the temperature of the material is brought below the Curie point, ferrimagnetism revives.

The term "ferromagnetic" refers to materials that exhibit ferromagnetism. Ferromagnetism is a physical phenomenon in which certain electrically uncharged materials strongly attract others. In contrast to other substances, ferromagnetic materials are magnetized easily, and in strong magnetic fields the magnetization approaches a definite limit called saturation. When a field is applied and then removed, the magnetization does not return to its original value. This phenomenon is referred to as hysteresis. When heated to a certain temperature called the Curie point, which is generally different for each substance, ferromagnetic materials lose their characteristic properties and cease to be magnetic; however, they become ferromagnetic again on cooling.

The term "magnet" can include a ferromagnetic material that responds to a magnetic field and acts as a magnet. A "magnet" can be any material that exerts a magnetic field in either a permanent, semi-permanent, or temporary state. The term "magnet" can be one individual magnet or an assembly of magnets that would act like a single magnet. The term "magnet" can include permanent magnets and electromagnets.

The terms "magnetic" and "magnetized" mean being ferromagnetic or ferrimagnetic at 20° C., or capable of being made so, unless otherwise specified. Preferably, magnetizable layers according to the present disclosure either have, or can be made to have by exposure to an applied magnetic field, a magnetic moment of at least 0.001 electromagnetic units (emu), more preferably at least 0.005 emu, more preferably 0.01 emu, up to an including 0.1 emu, although this is not a requirement.

The term "applied magnetic field" refers to a magnetic field that is deliberately created and excludes those generated by any natural (e.g., astronomical) body or bodies (e.g., Earth or the sun) or are the accidental result of environmental electric circuits (e.g., architectural electrical wiring).

The term "magnetizable" means capable of being magnetized or already in a magnetized state.

The term "shaped abrasive particle" refers to a ceramic abrasive particle that has been intentionally shaped (e.g., extruded, die cut, molded, screen-printed) at some point during its preparation such that the resulting abrasive particle is non-randomly shaped. The term "shaped abrasive particle" as used herein excludes abrasive particles obtained by a mechanical crushing or milling operation.

The term "platey crushed abrasive particle", which refers to a crushed abrasive particle resembling a platelet and/or flake that is characterized by a thickness that is less than the width and length. For example, the thickness may be less than ½, ⅓, ¼, ⅕, ⅙, ⅐, ⅛, ⅑, or even less than 1/10 of the length and/or width. Likewise, the width may be less than ½, ⅓, ¼, ⅕, ⅙, ⅐, ⅛, ⅑, or even less than 1/10 of the length.

The term "essentially free of" means containing less than 5 percent by weight (e.g., less than 4, 3, 2, 1, 0.1, or even less than 0.01 percent by weight, or even completely free) of, based on the total weight of the object being referred to.

The terms "precisely-shaped abrasive particle" refers to an abrasive particle wherein at least a portion of the abrasive particle has a predetermined shape that is replicated from a mold cavity used to form a precursor precisely-shaped abrasive particle that is sintered to form the precisely-shaped abrasive particle. A precisely-shaped abrasive particle will generally have a predetermined geometric shape that substantially replicates the mold cavity that was used to form the abrasive particle.

The term "length" refers to the longest dimension of an object.

The term "width" refers to the longest dimension of an object that is perpendicular to its length.

The term "thickness" refers to the longest dimension of an object that is perpendicular to both of its length and width.

The term "aspect ratio" refers to the ratio length/thickness of an object.

The term "substantially" means within 35 percent (preferably within 30 percent, more preferably within 25 percent, more preferably within 20 percent, more preferably within 10 percent, and more preferably within 5 percent) of the attribute being referred to.

The suffix "(s)" indicates that the modified word can be singular or plural.

Features and advantages of the present disclosure will be further understood upon consideration of the detailed description as well as the appended claims.

Figure 1:
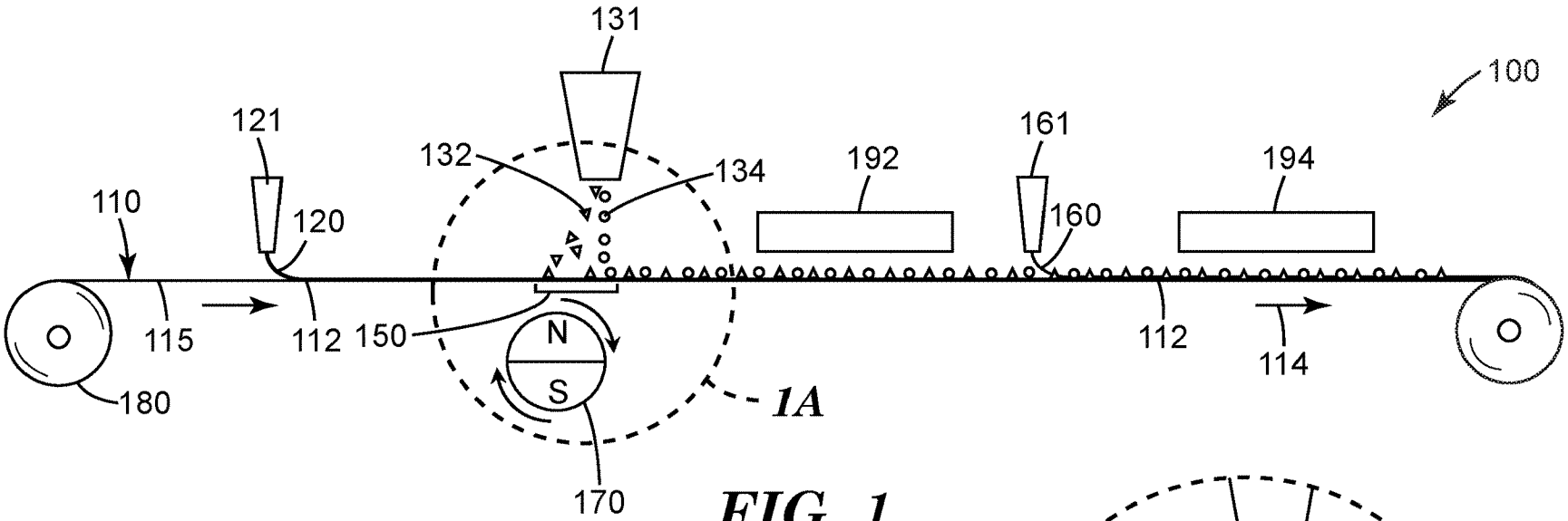
FIG. 1 is a schematic process flow diagram of an exemplary method 100 according to the present disclosure.

Repeated use of reference characters in the specification and drawings is intended to represent the same or analogous features or elements of the disclosure. It should be understood that numerous other modifications and embodiments can be devised by those skilled in the art, which fall within the scope and spirit of the principles of the disclosure. The figures may not be drawn to scale.

DETAILED DESCRIPTION

Figure 1A:
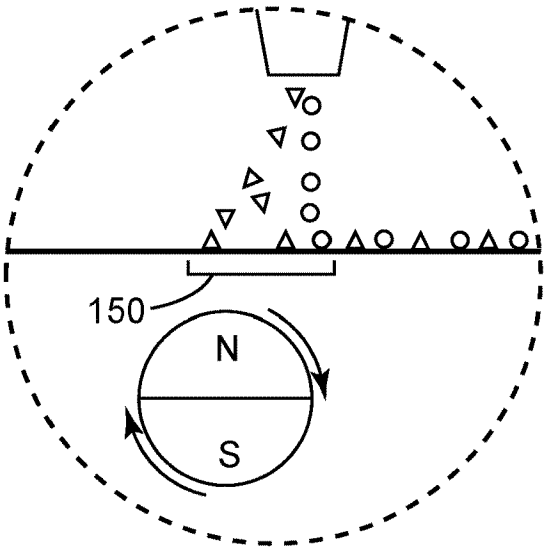
FIG. 1A is an enlarged view of region 1A in FIG. 1.

FIG. 1 depicts an exemplary method of making a coated abrasive article according to the present disclosure. Referring now to FIG. 1, in method 100, a web 110 comprising a backing 115 having a make layer precursor 120 disposed thereon moves along web path 112 in a downweb direction 114 (i. e, machine direction). Web 110 has a crossweb direction (not shown) that is perpendicular to downweb direction 114. Make layer precursor 120 is dispensed from coater 121 and comprises a first curable binder precursor (not shown). A mixture of magnetizable particles 132 and non-magnetizable particles 134 is dropped from hopper 131 through a portion of an applied magnetic field (not shown) created by rotating magnet 170 onto make layer precursor 120. Rotating magnet 170 has north (N) and south (S) poles. At least one of magnetizable particles 132 and non-magnetizable particles 134 (collectively the particles) are abrasive particles. Magnetizable particles 132 and the non-magnetizable particles 134 are predominantly deposited onto web 110 within a drop zone 150 at different locations (see FIG. 1A), resulting in a predetermined coating order under steady state operating conditions (i.e., with a moving web after startup). Various web handling components 180 (e.g., rollers, conveyor belts, feed rolls, and take up rolls) handle web 110 during manufacture of the coated abrasive article.

As shown in FIG. 1, the magnetizable particles are influenced by the applied magnetic field and are deposited upstream of the non-magnetic particles; however, the reverse orientation and/or location can also be effected by the same principle but changing the orientation of the applied magnetic field.

Once the particles are coated on to the make layer precursor it is at least partially cured at curing station 192, so as to firmly retain the particles in position.

Typically, a size layer precursor 160 comprising a second binder precursor (not shown) is then applied over the at least partially cured make layer precursor and the particles from coated 161, although this is not a requirement. If present, size layer precursor 160 is then at least partially cured at curing station 194, optionally with further curing of the at least partially cured make layer precursor. In some embodiments, a supersize layer (not shown) is coated overlaying the at least partially cured size layer precursor.

Lastly, the finished web is converted into useful forms of coated abrasive articles such as, for example, discs, sheets, and/or belts.

Figure 2:
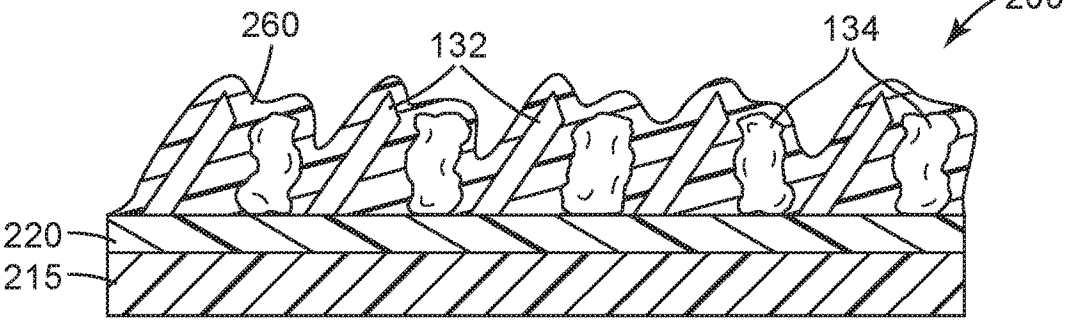
FIG. 2 is a schematic side view of an exemplary coated abrasive article 200 according to the present disclosure.

FIG. 2 shows an exemplary coated abrasive article 200 prepared according to the method of the present disclosure. Make layer 220 is disposed on backing 215. Size layer 260 overlays make layer 220, magnetizable particles 132 and non-magnetizable particles 134 thereby securing them to backing 215.

As will be apparent to those of skill in the art, the make layer precursor and the optional size layer precursor be coated using conventional techniques such as, for example, gravure coating, curtain coating, knife coating, spray coatings, roll-coating, reverse roll gravure coating, or bar coating.

Exemplary backings include those known in the art for making coated abrasive articles, including conventional sealed coated abrasive backings and porous non-sealed backings. Typically, the backing has two opposed major surfaces. The thickness of the backing generally ranges from about 0.02 to about 5 millimeters, desirably from about 0.05 to about 2.5 millimeters, and more desirably from about 0.1 to about 0.4 millimeter, although thicknesses outside of these ranges may also be useful.

The backing may be flexible or rigid. Desirably the backing is flexible. Exemplary backings include polymeric film (including primed films) such as polyolefin film (e.g., polypropylene including biaxially oriented polypropylene, polyester film, polyamide film, cellulose ester film), metal foil, mesh, foam (e.g., natural sponge material or polyurethane foam), cloth (e.g., cloth made from fibers or yarns comprising polyester, nylon, silk, cotton, and/or rayon), paper, vulcanized paper, vulcanized fiber, nonwoven materials, combinations thereof, and treated versions thereof. Cloth backings may be woven or stitch bonded. Desirably, the backing comprises polypropylene film.

The backing may be made of any number of various materials including those conventionally used as backings in the manufacture of coated abrasives. Examples include paper, cloth, film, polymeric foam, vulcanized fiber, woven, and nonwoven materials, combinations of two or more of these materials, as well as treated versions thereof. The backing may also be a laminate of two materials (e.g., paper/film, cloth/paper, film/cloth).

The backing may be treated to include a presize (i.e., a barrier coat overlying the major surface of the backing onto which the abrasive layer is applied), a backsize (i.e., a barrier coat overlying the major surface of the backing opposite the major surface on which the abrasive layer is applied), a saturant (i.e., a barrier coat that is coated on all exposed surfaces of the backing), or a combination thereof. Useful presize, backsize, and saturant compositions include glue, phenolic resins, lattices, epoxy resins, urea-formaldehyde, urethane, melamine-formaldehyde, neoprene rubber, butyl acrylate, styrol, starch, and combinations thereof. Other optional layers known in the art may also be used (e.g., a tie layer, see, e.g., U.S. Pat. No. 5,700,302 (Stoetzel et al.)).

Backing treatments may contain additional additives such as, for example, a filler and/or an antistatic material (for example, carbon black particles, vanadium pentoxide particles). The addition of an antistatic material can reduce the tendency of the coated abrasive article to accumulate static electricity when sanding wood or wood-like materials. Additional details regarding antistatic backings and backing treatments can be found in, for example, U.S. Pat. No. 5,108,463 (Buchanan et al.); U.S. Pat. No. 5,137,542 (Buchanan et al.); U.S. Pat. No. 5,328,716 (Buchanan); and U.S. Pat. No. 5,560,753 (Buchanan et al.).

Typically, at least one major surface of the backing is smooth (for example, to serve as the first major surface). The second major surface of the backing may comprise a slip resistant or frictional coating. Examples of such coatings include an inorganic particulate (e.g., calcium carbonate or quartz) dispersed in an adhesive.

The backing may contain various additive(s). Examples of suitable additives include colorants, processing aids, reinforcing fibers, heat stabilizers, UV stabilizers, and antioxidants. Examples of useful fillers include clays, calcium carbonate, glass beads, talc, clays, mica, wood flour; and carbon black.

The backing may be a fibrous reinforced thermoplastic such as described, for example, as described, for example, in U.S. Pat. No. 5,417,726 (Stout et al.), or an endless spliceless belt, for example, as described, for example, in U.S. Pat. No. 5,573,619 (Benedict et al.). Likewise, the backing may be a polymeric substrate having hooking stems projecting therefrom such as that described, for example, in U.S. Pat. No. 5,505,747 (Chesley et al.). Similarly, the backing may be a loop fabric such as that described, for example, in U.S. Pat. No. 5,565,011 (Follett et al.)

The make layer precursor and the size layer precursor compositions include respective first and second binder precursor composition, which may be the same or different. Both include a curable binder precursor composition.

Examples of curable binder precursor compositions for use in the make and/or size layer precursors include phenolic resins, urea-formaldehyde resins, acrylate resins, urethane resins, epoxy resins, aminoplast resins, and combinations thereof. The curable binder precursor compositions can also include various additives including, for example, grinding aids, plasticizers, fillers, fibers, lubricants, surfactants, wetting agents, dyes, pigments, antifoaming agents, dyes, coupling agents, plasticizers, and suspending agents.

Depending on any curable binder precursor composition selected, an appropriate curative may be added to facilitate curing. Such curatives will be readily apparent to those of skill in the art, and may be thermally activated, photochemically activated, or both, for example.

Optionally a supersize layer may be applied overlaying the size layer. Examples of useful supersize layer compositions include metal salts of fatty acids, urea-formaldehyde, novolac phenolic resins, epoxy resins, waxes, and mineral oils.

The magnetizable particles have sufficient magnetic susceptibility that they can be influenced (e.g., attracted or repelled) by the applied magnetic field. Any magnetizable particle may be used.

Otherwise non-magnetic particles can be rendered magnetizable; for example, by coating some or all of the particle surface with a ferromagnetic material coating.

Examples of magnetizable coatings include coatings of an adhesive (e.g., waterglass) and magnetizable particles such as, for example, ferromagnetic metals, and/or ferromagnetic metal oxides.

In one embodiment, the outer surfaces of abrasive particles are moistened with waterglass. As used herein, the term "waterglass" refers to an aqueous solution of alkali silicate(s) (e.g., lithium, sodium, and/or potassium silicate) and combinations thereof. Alkali silicate is the common name for compounds with the formula $(SiO_2)_n(M_2O)$ and their hydrates where n is a positive integer and M is an alkali metal (e.g., sodium or potassium). A well-known member of this series is sodium metasilicate, $Na_2SiO_3$ (i.e., n=1, M=Na), which is commercially available in anhydrous and hydrated forms (e.g., $Na_2SiO_3.5H_2O$). While water should generally be the primary liquid component, organic cosolvents (e.g., methanol, ethanol, isopropanol, glyme, diglyme, propylene glycol, and/or acetone) may also be present. Other components such as, for example, surfactant(s), thickener(s), thixotrope(s), and colorant(s), may be included in the waterglass if desired. The concentration of alkali silicate in the waterglass is not critical (as long as it is dissolved and the waterglass is liquid), but it is preferably from 25 to 70 percent by weight, more preferably 30 to 55 percent by weight. In this context, percent by weight is to be calculated based on the anhydrous form of alkali silicate(s) that is/are present in the waterglass.

The magnetizable particles included with the waterglass may comprise magnetizable material such as, for example: iron; cobalt; nickel; various alloys of nickel and iron marketed as Permalloy in various grades; various alloys of iron, nickel and cobalt marketed as Fernico, Kovar, FerNiCo I, or FerNiCo II; various alloys of iron, aluminum, nickel, cobalt, and sometimes also copper and/or titanium marketed as Alnico in various grades; alloys of iron, silicon, and aluminum (typically about 85:9:6 by weight) marketed as Sendust alloy; Heusler alloys (e.g., $Cu_2MnSn$); manganese bismuthide (also known as Bismanol); rare earth magnetizable materials such as gadolinium, dysprosium, holmium, europium oxide, alloys of neodymium, iron and boron (e.g., $Nd_2Fe_{14}B$), and alloys of samarium and cobalt (e.g., $SmCo_5$); MnSb; $MnOFe_2O_3$; $Y_3Fe_5O_{12}$; $CrO_2$; MnAs; ferrites such as ferrite, magnetite; zinc ferrite; nickel ferrite; cobalt ferrite, magnesium ferrite, barium ferrite, and strontium ferrite; yttrium iron garnet; and combinations of the foregoing. In some preferred embodiments, the magnetizable material comprises at least one metal selected from iron, nickel, and cobalt, an alloy of two or more such metals, or an alloy of at one such metal with at least one element selected from phosphorus and manganese. In some preferred embodiments, the magnetizable material is an alloy containing 8 to 12 weight percent (wt. %) aluminum, 15 to 26 wt. % nickel, 5 to 24 wt. % cobalt, up to 6 wt. % copper, up to 1% titanium, wherein the balance of material to add up to 100 wt. % is iron.

In some other embodiments, a magnetizable layer can be deposited on an abrasive particle body using a vapor deposition technique such as, for example, physical vapor deposition (PVD) including magnetron sputtering. PVD metallization of various metals, metal oxides and metallic alloys is disclosed in, for example, U.S. Pat. No. 4,612,242 (Vesley) and U.S. Pat. No. 7,727,931 (Brey et al.).

Examples of metallic materials that can be vapor-deposited include stainless steels, nickel, cobalt. Exemplary useful magnetizable particles/materials can comprise: iron; cobalt; nickel; various alloys of nickel and iron marketed as Permalloy in various grades; various alloys of iron, nickel and cobalt marketed as Fernico, Kovar, FerNiCo I, or FerNiCo II; various alloys of iron, aluminum, nickel, cobalt, and sometimes also copper and/or titanium marketed as Alnico in various grades; alloys of iron, silicon, and aluminum (typically about 85:9:6 by weight) marketed as Sendust alloy; Heusler alloys (e.g., $Cu_2MnSn$); manganese bismuthide (also known as Bismanol); rare earth magnetizable materials such as gadolinium, dysprosium, holmium, europium oxide, and alloys of samarium and cobalt (e.g., $SmCo_5$); MnSb; ferrites such as ferrite, magnetite; zinc ferrite; nickel ferrite; cobalt ferrite, magnesium ferrite, barium ferrite, and strontium ferrite; and combinations of the foregoing. In some embodiments, the magnetizable material comprises at least one metal selected from iron, nickel, and cobalt, an alloy of two or more such metals, or an alloy of at one such metal with at least one element selected from phosphorus and manganese. In some embodiments, the magnetizable material is an alloy containing 8 to 12 weight percent (wt. %) aluminum, 15 to 26 wt. % nickel, 5 to 24 wt. % cobalt, up to 6 wt. % copper, up to 1 wt. % titanium, wherein the balance of material to add up to 100 wt. % is iron. Alloys of this type are available under the trade designation "ALNICO".

Any ratio of magnetizable to non-magnetizable particles may be used. In some embodiments, the weight percentage of the magnetizable particles to the total weight of particles may be at least 35 percent, at least 40 percent, at least 45 percent, at least 50 percent, at least 55 percent, at least 60 percent, at least 65 percent, at least 70 percent, at least 75 percent, at least 80 percent, at least 85 percent, at least 90 percent, or even at least 95 percent. In some embodiments, the weight percentage of the non-magnetizable particles to the total weight of particles may be at least 35 percent, at least 40 percent, at least 45 percent, at least 50 percent, at least 55 percent, at least 60 percent, at least 65 percent, at least 70 percent, at least 75 percent, at least 80 percent, at least 85 percent, at least 90 percent, or even at least 95 percent.

The magnetizable particles and the non-magnetizable particles may have the same or different specified nominal size grade. The magnetizable particles and the non-magnetizable particles may each have a monomodal or polymodal (e.g., bimodal, trimodal) distribution.

The magnetizable particles and the non-magnetizable particles may comprise the same or different base material compositions. In some preferred embodiments, the magnetizable particles comprise abrasive particles. In some preferred embodiments, the non-magnetizable particles comprise abrasive particles and/or grinding aid particles.

The abrasive particles, whether crushed or shaped, magnetizable or non-magnetizable, should have sufficient hardness and surface roughness to function as abrasive particles in an abrading process. Preferably, the abrasive particles have a Mohs hardness of at least 4, at least 5, at least 6, at least 7, or even at least 8.

Useful abrasive materials that can be used as abrasive particles include, for example, fused aluminum oxide, heat treated aluminum oxide, white fused aluminum oxide, ceramic aluminum oxide materials such as those commercially available as 3M CERAMIC ABRASIVE GRAIN from 3M Company of St. Paul, Minn., black silicon carbide, green silicon carbide, titanium diboride, boron carbide, tungsten carbide, titanium carbide, cubic boron nitride, garnet, fused alumina zirconia, sol-gel derived ceramics (e.g., alumina ceramics doped with chromia, ceria, zirconia, titania, silica, and/or tin oxide), silica (e.g., quartz, glass beads, glass bubbles and glass fibers), feldspar, or flint. Examples of sol-gel derived crushed ceramic particles can be found in U.S. Pat. No. 4,314,827 (Leitheiser et al.), U.S. Pat. No. 4,623,364 (Cottringer et al.); U.S. Pat. No. 4,744,802 (Schwabel), U.S. Pat. No. 4,770,671 (Monroe et al.); and U.S. Pat. No. 4,881,951 (Monroe et al.).

As discussed previously, the magnetizable and/or non-magnetizable particles may be shaped (e.g., precisely-shaped) or random (e.g., crushed). Shaped abrasive particles and precisely-shaped abrasive particles can be prepared by a molding process using sol-gel technology as described in U.S. Pat. No. 5,201,916 (Berg); U.S. Pat. No. 5,366,523 (Rowenhorst (Re 35,570)); and U.S. Pat. No. 5,984,988 (Berg). U.S. Pat. No. 8,034,137 (Erickson et al.) describes alumina particles that have been formed in a specific shape, then crushed to form shards that retain a portion of their original shape features. Applying a magnetizable coating to the surface of a shaped non-magnetizable abrasive particle may result in a shaped magnetizable abrasive particle.

Exemplary shapes of abrasive particles include crushed, pyramids (e.g., 3-, 4-, 5-, or 6-sided pyramids), truncated pyramids (e.g., 3-, 4-, 5-, or 6-sided truncated pyramids), cones, truncated cones, rods (e.g., cylindrical, vermiform), and prisms (e.g., 3-, 4-, 5-, or 6-sided prisms).

Crushed abrasive particles (including platey crushed abrasive particles) can be obtained from commercial sources, by known methods, and/or by shape sorting crushed abrasive particles; for example, using a shape-sorting table as is known in the art.

Examples of suitable abrasive particles include crushed abrasive particles comprising fused aluminum oxide, heat-treated aluminum oxide, white fused aluminum oxide, ceramic aluminum oxide materials such as those commercially available as 3M CERAMIC ABRASIVE GRAIN from 3M Company, brown aluminum oxide, blue aluminum oxide, silicon carbide (including green silicon carbide), titanium diboride, boron carbide, tungsten carbide, garnet, titanium carbide, diamond, cubic boron nitride, garnet, fused alumina zirconia, iron oxide, chromia, zirconia, titania, tin oxide, quartz, feldspar, flint, emery, sol-gel-derived ceramic (e.g., alpha alumina), and combinations thereof. Further examples include crushed abrasive composites of abrasive particles (which may be platey or not) in a binder matrix, such as those described in U.S. Pat. No. 5,152,917 (Pieper et al.). Many such abrasive particles, agglomerates, and composites are known in the art.

Examples of sol-gel-derived abrasive particles from which crushed abrasive particles can be isolated, and methods for their preparation can be found, in U.S. Pat. No. 4,314,827 (Leitheiser et al.); U.S. Pat. No. 4,623,364 (Cottringer et al.); U.S. Pat. No. 4,744,802 (Schwabel), U.S. Pat. No. 4,770,671 (Monroe et al.); and U.S. Pat. No. 4,881,951 (Monroe et al.). It is also contemplated that the crushed abrasive particles could comprise abrasive agglomerates such, for example, as those described in U.S. Pat. No. 4,652,275 (Bloecher et al.) or U.S. Pat. No. 4,799,939 (Bloecher et al.). In some embodiments, the crushed abrasive particles may be surface-treated with a coupling agent (e.g., an organosilane coupling agent) or other physical treatment (e.g., iron oxide or titanium oxide) to enhance adhesion of the crushed abrasive particles to a binder. The crushed abrasive particles may be treated before combining them with the binder, or they may be surface treated in situ by including a coupling agent to the binder.

Preferably, the crushed abrasive particles comprise ceramic crushed abrasive particles such as, for example, sol-gel-derived polycrystalline alpha alumina particles. Ceramic crushed abrasive particles composed of crystallites of alpha alumina, magnesium alumina spinel, and a rare earth hexagonal aluminate may be prepared using sol-gel precursor alpha alumina particles according to methods described in, for example, U.S. Pat. No. 5,213,591 (Celikkaya et al.) and U. S. Publ. Pat. Appln. Nos. 2009/0165394 A1 (Culler et al.) and 2009/0169816 A1 (Erickson et al.).

Further details concerning methods of making sol-gel-derived abrasive particles can be found in, for example, U.S. Pat. No. 4,314,827 (Leitheiser); U.S. Pat. No. 5,152,917 (Pieper et al.); U.S. Pat. No. 5,435,816 (Spurgeon et al.); U.S. Pat. No. 5,672,097 (Hoopman et al.); U.S. Pat. No. 5,946,991 (Hoopman et al.); U.S. Pat. No. 5,975,987 (Hoopman et al.); and U.S. Pat. No. 6,129,540 (Hoopman et al.); and in U. S. Publ. Pat. Appln. No. 2009/0165394 A1 (Culler et al.).

If desired, shaped magnetizable and/or non-magnetizable particles may be used in conjunction with the crushed magnetizable and/or non-magnetizable particles. Examples of shaped abrasive particles can be found in U.S. Pat. No. 5,201,916 (Berg); U.S. Pat. No. 5,366,523 (Rowenhorst (Re 35,570)); and U.S. Pat. No. 5,984,988 (Berg). U.S. Pat. No. 8,034,137 (Erickson et al.) describes alumina crushed abrasive particles that have been formed in a specific shape, then crushed to form shards that retain a portion of their original shape features. In some embodiments, shaped alpha alumina particles are precisely-shaped (i.e., the particles have shapes that are at least partially determined by the shapes of cavities in a production tool used to make them. Details concerning such crushed abrasive particles and methods for their preparation can be found, for example, in U.S. Pat. No. 8,142,531 (Adefris et al.); U.S. Pat. No. 8,142,891 (Culler et al.); and U.S. Pat. No. 8,142,532 (Erickson et al.); and in U. S. Pat. Appl. Publ. Nos. 2012/0227333 (Adefris et al.); 2013/0040537 (Schwabel et al.); and 2013/0125477 (Adefris).

Surface coatings on the various abrasive particles may be used to improve the adhesion between the abrasive particles and a binder in abrasive articles, or can be used to aid in electrostatic deposition. In one embodiment, surface coatings as described in U.S. Pat. No. 5,352,254 (Celikkaya) in an amount of 0.1 to 2 percent surface coating to abrasive particle weight may be used. Such surface coatings are described in U.S. Pat. No. 5,213,591 (Celikkaya et al.); U.S. Pat. No. 5,011,508 (Wald et al.); U.S. Pat. No. 1,910,444 (Nicholson); U.S. Pat. No. 3,041,156 (Rowse et al.); U.S. Pat. No. 5,009,675 (Kunz et al.); U.S. Pat. No. 5,085,671 (Martin et al.); U.S. Pat. No. 4,997,461 (Markhoff-Matheny et al.); and U.S. Pat. No. 5,042,991 (Kunz et al.). Additionally, the surface coating may prevent the shaped abrasive particle from capping. Capping is the term to describe the phenomenon where metal particles from the workpiece being abraded become welded to the tops of the crushed abrasive particles. Surface coatings to perform the above functions are known to those of skill in the art.

Crushed abrasive particles used in practice of the present disclosure (e.g., the initial crushed abrasive particles and the optional crushed filler particles) are preferably selected to have a length and/or width in a range of from 0.1 micron to 3500 microns, magnetizable particles have an average maximum particle dimension of 25 to 3000 microns, more typically 100 microns to 3000 microns, and more typically 100 microns to 2600 microns, although other lengths and widths may also be used.

Crushed abrasive particles may be selected to have a thickness in a range of from 0.1 micron to 1600 microns, more typically from 1 micron to 1200 microns, although other thicknesses may be used. In some embodiments, platey crushed abrasive particles may have an aspect ratio (length to thickness) of at least 2, 3, 4, 5, 6, or more.

Length, width, and thickness of the abrasive particles can be determined on an individual or average basis, as desired. Suitable techniques may include inspection and measurement of individual particles, as well as using automated image analysis techniques (e.g., using a dynamic image analyzer such as a CAMSIZER XT image analyzer from Retsch Technology Gmbh of Haan, Germany) according to test method ISO 13322-2:2006 "Particle size analysis—Image analysis methods—Part 2: Dynamic image analysis methods".

The magnetizable and/or non-magnetizable particles may be independently sized according to an abrasives industry recognized specified nominal grade. Exemplary abrasive industry recognized grading standards include those promulgated by ANSI (American National Standards Institute), FEPA (Federation of European Producers of Abrasives), and JIS (Japanese Industrial Standard). ANSI grade designations (i.e., specified nominal grades) include, for example: ANSI 4, ANSI 6, ANSI 8, ANSI 16, ANSI 24, ANSI 36, ANSI 46, ANSI 54, ANSI 60, ANSI 70, ANSI 80, ANSI 90, ANSI 100, ANSI 120, ANSI 150, ANSI 180, ANSI 220, ANSI 240, ANSI 280, ANSI 320, ANSI 360, ANSI 400, and ANSI 600. FEPA grade designations include F4, F5, F6, F7, F8, F10, F12, F14, F16, F20, F22, F24, F30, F36, F40, F46, F54, F60, F70, F80, F90, F100, F120, F150, F180, F220, F230, F240, F280, F320, F360, F400, F500, F600, F800, F1000, F1200, F1500, and F2000. JIS grade designations include JIS8, JIS12, JIS16, JIS24, JIS36, JIS46, JIS54, JIS60, JIS80, JIS100, JIS150, JIS180, JIS220, JIS240, JIS280, JIS320, JIS360, JIS400, JIS600, JIS800, JIS1000, JIS1500, JIS2500, JIS4000, JIS6000, JIS8000, and JIS10,000

According to an embodiment of the present disclosure, the average diameter of the crushed abrasive particles may be within a range of from 260 to 1400 microns in accordance with FEPA grades F60 to F24.

Alternatively, the initial and/or optional crushed filler particles (e.g., crushed abrasive filler particles) can be graded to a nominal screened grade using U.S.A. Standard Test Sieves conforming to ASTM E-11 "Standard Specification for Wire Cloth and Sieves for Testing Purposes".

ASTM E-11 prescribes the requirements for the design and construction of testing sieves using a medium of woven wire cloth mounted in a frame for the classification of materials according to a designated particle size. A typical designation may be represented as −18+20 meaning that the crushed abrasive particles pass through a test sieve meeting ASTM E-11 specifications for the number 18 sieve and are retained on a test sieve meeting ASTM E-11 specifications for the number 20 sieve. In one embodiment, the crushed abrasive particles have a particle size such that most of the particles pass through an 18 mesh test sieve and can be retained on a 20, 25, 30, 35, 40, 45, or 50 mesh test sieve. In various embodiments, the crushed abrasive particles can have a nominal screened grade of: −18/+20, −20/+25, −25/+30, −30/+35, −35/+40, −40/+45, −45/+50, −50/+60, −60/+70, −70/+80, −80/+100, −100/+120, −120/+140, −140/+170, −170/+200, −200/+230, −230/+270, −270/+325, −325/+400, −400/+450, −450/+500, or −500/+635. Alternatively, a custom mesh size can be used such as −90/+100.

Coated abrasive articles according to the present invention may be converted, for example, into belts, rolls, discs (including perforated discs), and/or sheets. For belt applications, two free ends of the abrasive sheet may be joined together using known methods to form a spliced belt.

In addition to the description contained hereinabove, further description of techniques and materials for making coated abrasive articles may be found in, for example, U.S. Pat. No. 4,314,827 (Leitheiser et al.); U.S. Pat. No. 4,518,397 (Leitheiser et al.); U.S. Pat. No. 4,623,364 (Cottringer et al.); U.S. Pat. No. 4,652,275 (Bloecher et al.); U.S. Pat. No. 4,734,104 (Broberg); U.S. Pat. No. 4,737,163 (Larkey); U.S. Pat. No. 4,744,802 (Schwabel); U.S. Pat. No. 4,770,671 (Monroe et al.); U.S. Pat. No. 4,799,939 (Bloecher et al.); U.S. Pat. No. 4,881,951 (Wood et al.); U.S. Pat. No. 4,927,431 (Buchanan et al.); U.S. Pat. No. 5,498,269 (Larmie); U.S. Pat. No. 5,011,508 (Wald et al.); U.S. Pat. No. 5,078,753 (Broberg et al.); U.S. Pat. No. 5,090,968 (Pellow); U.S. Pat. No. 5,108,463 (Buchanan et al.); U.S. Pat. No. 5,137,542 (Buchanan et al.); U.S. Pat. No. 5,139,978 (Wood); U.S. Pat. No. 5,152,917 (Pieper et al.); U.S. Pat. No. 5,203,884 (Buchanan et al.); U.S. Pat. No. 5,227,104 (Bauer); and U.S. Pat. No. 5,328,716 (Buchanan).

Coated abrasive articles according to the present disclosure are useful, for example, for abrading a workpiece. Examples of workpiece materials include metal, metal alloys, exotic metal alloys, ceramics, glass, wood, wood-like materials, composites, painted surfaces, plastics, reinforced plastics, stone, and/or combinations thereof. The workpiece may be flat or have a shape or contour associated with it. Exemplary workpieces include metal components, plastic components, particleboard, camshafts, crankshafts, furniture, and turbine blades. The applied force during abrading typically ranges from about 1 kilogram to about 100 kilograms.

Abrasive articles according to the present disclosure may be used by hand and/or used in combination with a machine. At least one of the abrasive article and the workpiece is moved relative to the other when abrading. Abrading may be conducted under wet or dry conditions. Exemplary liquids for wet abrading include water, water containing conventional rust inhibiting compounds, lubricant, oil, soap, and cutting fluid. The liquid may also contain defoamers, degreasers, for example.

The applied magnetic field can be provided by one or more permanent magnets and/or electromagnet(s), for example. Preferred permanent magnets include rare-earth magnets comprising magnetizable materials are described hereinabove. The applied magnetic field can be static or variable (e.g., modulating).

Referring now to FIG. 3, in an exemplary embodiment, the applied magnetic field 300 is provided by a rotating magnet 310 having a rotational axis 320 that is substantially parallel to the crossweb direction of at least a portion of the web 330 path within the drop zone 340. In steady state operation, as the web travels from upstream to downstream along the web path, the magnetizable particles are influenced by the applied magnetic field and predominantly deposited onto the web upstream of the non-magnetizable particles.

In general, applied magnetic fields used in practice of the present disclosure have a field strength in the region of the magnetizable particles being affected (e.g., attracted and/or oriented) of at least about 10 gauss (1 mT), preferably at least about 100 gauss (10 mT), and more preferably at least about 1000 gauss (0.1 T), although this is not a requirement.

The mixture of magnetizable particles and non-magnetizable particles may be passed through at least a portion of the applied magnetic field by any suitable method. One preferred method is by dropping the particles through the applied magnetic field. Another suitable method involves electrostatically propelling the particles through the applied magnetic field.

SELECT EMBODIMENTS OF THE PRESENT DISCLOSURE

In a first embodiment, the present disclosure provides a method of making a coated abrasive article, the method comprising:

a) providing a web comprising a backing having a make layer precursor disposed thereon, wherein the web moves along a web path in a downweb direction, wherein the web has a crossweb direction that is perpendicular to the downweb direction, and wherein the make layer precursor comprises a first curable binder precursor, b) providing an applied magnetic field;

c) passing a mixture of magnetizable particles and non-magnetizable particles through at least a portion of the applied magnetic field and onto the make layer precursor such that the magnetizable particles and the non-magnetizable particles are predominantly deposited onto the web in a drop zone according to a predetermined order, wherein at least one of the magnetizable particles or the non-magnetizable particles comprises abrasive particles; and d) at least partially curing the make layer precursor to provide a make layer.

In a second embodiment, the present disclosure provides a method of making a coated abrasive article according to the first embodiment, wherein the applied magnetic field is constant.

In a third embodiment, the present disclosure provides a method of making a coated abrasive article according to the first embodiment, wherein the applied magnetic field is modulated.

In a fourth embodiment, the present disclosure provides a method of making a coated abrasive article according to the third embodiment, wherein the applied magnetic field is provided by a rotating magnet having a rotational axis that is substantially parallel to the crossweb direction of at least a portion of the web path within the drop zone.

In a fifth embodiment, the present disclosure provides a method of making a coated abrasive article according to the fourth embodiment, wherein the rotating magnet is horizontally offset from the drop zone.

In a sixth embodiment, the present disclosure provides a method of making a coated abrasive article according to the fourth or fifth embodiment, wherein the rotational direction of the rotating magnet, nearest to the web, is the same as the downweb direction.

In a seventh embodiment, the present disclosure provides a method of making a coated abrasive article according to any one of the first to sixth embodiments, wherein the web travels from upstream to downstream along the web path, and wherein in steady state operation the magnetizable particles are predominantly deposited onto the web upstream of the non-magnetizable particles.

In an eighth embodiment, the present disclosure provides a method of making a coated abrasive article according to any one of the first to sixth embodiments, wherein the web travels from upstream to downstream along the web path, and wherein in steady state operation the magnetizable particles are predominantly deposited onto the web downstream of the non-magnetizable particles.

In a ninth embodiment, the present disclosure provides a method of making a coated abrasive article according to any one of the first to eighth embodiments, further comprising before step d) disposing a size layer precursor comprising a second curable binder precursor over the make layer precursor and magnetizable particles and non-magnetizable particles, wherein in step d) the size layer precursor is at least partially cured to provide a size layer.

In a tenth embodiment, the present disclosure provides a method of making a coated abrasive article according to any one of the first to eighth embodiments, further comprising after step d) disposing a size layer precursor comprising a second curable binder precursor over the make layer, magnetizable particles, and non-magnetizable particles, and at least partially curing the size layer precursor to provide a size layer.

In an eleventh embodiment, the present disclosure provides a method of making a coated abrasive article according to any one of the first to tenth embodiments, wherein the magnetizable particles have an average maximum particle dimension of 25 to 3000 microns.

In a twelfth embodiment, the present disclosure provides a method of making a coated abrasive article according to any one of the first to eleventh embodiments, wherein passing the mixture of magnetizable particles and non-magnetizable particles through at least a portion of the applied magnetic field comprises dropping the mixture of magnetizable particles and non-magnetizable particles through at least a portion of the applied magnetic field.

In a thirteenth embodiment, the present disclosure provides a method of making a coated abrasive article according to any one of the first to twelfth embodiments, wherein the non-magnetizable particles comprise grinding aid particles.

In a fourteenth embodiment, the present disclosure provides a method of making a coated abrasive article according to any one of the first to twelfth embodiments, wherein the non-magnetizable particles comprise grinding aid particles.

In a fifteenth embodiment, the present disclosure provides a method of making a coated abrasive article according to any one of the first to fourteenth embodiments, wherein the non-magnetizable particles comprise abrasive particles having a Mohs hardness of at least 4.

In a sixteenth embodiment, the present disclosure provides a method of making a coated abrasive article according to any one of the first to fifteenth embodiments, wherein the magnetizable particles comprise abrasive particles having a Mohs hardness of at least 4.

In a seventeenth embodiment, the present disclosure provides a method of making a coated abrasive article according to the fifteenth or sixteenth embodiments, wherein the abrasive particles comprise alumina.

In an eighteenth embodiment, the present disclosure provides a method of making a coated abrasive article according to any one of the fifteenth to seventeenth embodiments, wherein the abrasive particles are shaped as triangular platelets.

In a nineteenth embodiment, the present disclosure provides a method of making a coated abrasive article according to any one of the fifteenth to seventeenth embodiments, wherein the abrasive particles are precisely-shaped.

Objects and advantages of this disclosure are further illustrated by the following non-limiting examples, but the particular materials and amounts thereof recited in these examples, as well as other conditions and details, should not be construed to unduly limit this disclosure.

EXAMPLES

Unless otherwise noted, all parts, percentages, ratios, etc. in the Examples and the rest of the specification are by weight.

Unless stated otherwise, all other reagents were obtained, or are available from chemical vendors such as Sigma-Aldrich Company, St. Louis, Mo., or may be synthesized by known methods.

Abbreviations for materials and reagents used in the examples are listed as follows.

PF1 Phenol-formaldehyde resin having a phenol to formaldehyde molar ratio of 1.5-2.1, and catalyzed with 2.5 percent by weight potassium hydroxide.

BACK1 Polyester backing, according to the description disclosed in Example 12 in U.S. Pat. No. 6,843,815 (Thurber et al.).

FIL1 Calcium Silicate obtained as M400 WOLLASTOCOAT from NYCO, Willsboro, N.Y.

FIL2 Cryolite obtained as CRYOLITE RTN-C from FREEBEE A/S, Ullerslev, Denmark.

WAX1 A micronized synthetic wax, obtained as MP-22VF from Micropowders Inc., Tarrytown, N.Y.

RIO Red iron oxide pigment, obtained as KROMA RO-3097 from Elementis, East Saint Louis, Ill.

MIN1 Shaped abrasive particles were prepared according to the disclosure of U.S. Pat. No. 8,142,531 (Adefris et al.). The shaped abrasive particles were prepared by molding alumina sol gel in equilateral triangle-shaped polypropylene mold cavities. The fired shaped abrasive particles were about 0.51 mm (side length)×0.096 mm thick.

MIN2 ANSI grade 120 aluminum oxide abrasive mineral, obtained as DURALUM G52 BROWN ALUMINUM OXIDE GRADE 120 from Washington Mills Electro Minerals Corporation, Niagara Falls, N.Y.

Assembly of Magnetic Apparatus MAG1

Six diametrically magnetized cylinder magnets of dimensions 50.8 mm outer diameter by 50.8 mm width by 6.35 mm center hole inner diameter (obtained as RY04Y0DIA from K&J Magnetic Inc., Plumsteadville, Pa.) were affixed to a 6.22 mm 304 stainless steel shaft with epoxy (obtained as EPOXY ADHESIVE DP460 from 3M Company) with all north poles facing the same direction; essentially creating a single diametrically magnetized cylinder magnet with dimensions 50.8 mm diameter by 304.8 mm. This resultant cylinder magnet MAG1 was connected to an electric DC motor (obtained as LEESON 108020.00 1HP DC motor from W. W. Grainger, Lake Forest, Ill.) to spin it about its axis.

Example 1

A make layer precursor adhesive composition was prepared by charging a 4-liter plastic container with 1521 grams of PF1 and 1236 grams of FIL1, mechanically mixing, and then diluting to a total weight of 3 kilograms with water.

BACK1 was coated with the make layer precursor adhesive composition at a coating weight of 180.0 grams per square meter (g/m$^2$) using a roll coating method.

MIN1 was coated with 304 stainless steel using physical vapor deposition with magnetron sputtering, 304 stainless steel sputter target, described by Barbee et al. in Thin Solid Films, 1979, vol. 63, pp. 143-150, deposited as the magnetic ferritic body centered cubic form. The apparatus used for preparation of 304 stainless steel film coated abrasive particles (i.e., magnetizable abrasive particles) was disclosed in U.S. Pat. No. 8,698,394 (McCutcheon et al.). 3592 grams of MIN1 were placed in a particle agitator that was disclosed in U.S. Pat. No. 7,727,931 (Brey et al., Column 13, line 60). The blade end gap distance to the walls of the agitator was 1.7 mm. The physical vapor deposition was carried out for 12 hours at 5.0 kilowatts at an argon sputtering gas pressure of 10 millitorr (1.33 pascal) onto MIN1. The density of the coated MIN1 was 3.912 grams per cubic centimeter (the density of the uncoated SAP was 3.887 grams per cubic centimeter). The weight percentage of metal coating in the coated abrasive particles was 0.65% and the coating thickness was 1 micron.

A uniform abrasive particle blend of 50% MIN1 and 50% MIN2 was created at a total batch size of 10 kg. The blend of MIN1 and MIN2 were placed into a hopper that utilized a moving belt with a knife gap of 2 mm in respect to the hopper to precisely meter the amount of mineral onto an incoming web. A thin ramp was used to lessen the impact of the particles onto the moving web and was at an angle of 30 degrees and the end of the ramp was positioned 15 mm above the incoming BACK1. The ramp was positioned such that the MIN2 particles landed on BACK1 directly above the top of MAG. The gap between BACK1 and MAG1 was 6 mm. While the blend of MIN1 and MIN2 approached the make-coated BACK1, MAG1 was rotating about its axis at 2000 revolutions per minute (rpm) such that the surface of the cylinder was moving in the opposite direction of the incoming BACK.

The total coating weight of the blend of MIN1 and MIN2 was 355 g/m$^2$. The resultant abrasive web was then placed in an oven at 65.6° C. for 15 minutes followed by 90 minutes at 98.9° C. A size coat of 69.9 parts PF1, 7.0 parts FIL2, 13.3 parts WAX1, 1.4 part RIO and 8.4 parts water was then applied to the make resin and mineral coated backing at a coating weight of 367 g/m$^2$. The coated backing roll was then placed in the oven at 175° F. (79.4° C.) for 20 min followed by 65 minutes at 210° F. (98.9° C.). The backing material was then wound into a roll and placed in an oven for forced air cure for 12 hours at 102.8° C.

Example 2

The procedure generally described in EXAMPLE 1 was repeated, with the exception that the end of the particle feeding ramp was positioned 30 mm upstream of the center of the rotating MAG1 while still maintaining a height 30 mm above the incoming resin-coated BACK1.

Example 3

The procedure generally described in EXAMPLE 1 was repeated, with the exception that the end of the particle feeding ramp was positioned 30 mm downweb of the center of the rotating MAG1 while still maintaining a height of 30 mm above the incoming resin-coated BACK1.

Grinding Test

The grinding test was conducted on a 10.16 centimeters (cm)×91.44 cm belt converted from coated abrasive samples obtained from EXAMPLES 1 to 3. The workpiece was a 6061 aluminum bar on which the surface to be abraded measured 1.9 cm by 1.9 cm. A 20.3 cm diameter 50 durometer rubber, 1:1 land to groove ratio, serrated contact wheel was used. The belt was run at 2750 revolutions per minute. The workpiece was applied to the center part of the belt at a normal force 2.27 kilograms. The test consisted of measuring the weight loss of the workpiece after 15 seconds of grinding. The workpiece was then cooled and tested again. The test was concluded after 40 cycles. The total cut in grams was defined as the total weight loss of the workpiece after 40 cycles. Also, the weight loss of the abrasive belt was recorded as wear after 40 cycles. Results are reported in Table 1, below.

TABLE 1

| EXAMPLE | TOTAL CUT, grams | WEAR, grams |
|---|---|---|
| 1 | 86.5 | 1.31 |
| 2 | 91.6 | 1.16 |
| 3 | 102.1 | 0.85 |

All cited references, patents, and patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

The invention claimed is:

1. A method of making a coated abrasive article, the method comprising:

a) providing a web comprising a backing having a make layer precursor disposed thereon, wherein the web moves along a web path in a downweb direction, wherein the web has a crossweb direction that is perpendicular to the downweb direction, and wherein the make layer precursor comprises a first curable binder precursor;

b) providing an applied magnetic field, wherein the applied magnetic field is provided by a rotating magnet having a rotational axis that is substantially parallel to the crossweb direction of at least a portion of the web path within the drop zone;

c) passing a mixture of magnetizable particles and non-magnetizable particles through at least a portion of the applied magnetic field and onto the make layer precursor such that the magnetizable particles and the non-magnetizable particles are predominantly deposited onto the web in a drop zone according to a predetermined order, wherein at least one of the magnetizable particles or the non-magnetizable particles comprises abrasive particles; and d) at least partially curing the make layer precursor to provide a make layer.

2. The method of claim 1 wherein the rotating magnet is horizontally offset from the drop zone.

3. The method of claim 1, wherein the rotational direction of the rotating magnet, nearest to the web, is the same as the downweb direction.

4. The method of claim 1, wherein the web travels from upstream to downstream along the web path, and wherein in steady state operation the magnetizable particles are predominantly deposited onto the web upstream of the non-magnetizable particles.

5. The method of claim 1, wherein the web travels from upstream to downstream along the web path, and wherein in steady state operation the magnetizable particles are predominantly deposited onto the web downstream of the non-magnetizable particles.

6. The method of claim 1, further comprising before step d) disposing a size layer precursor comprising a second curable binder precursor over the make layer precursor and magnetizable particles and non-magnetizable particles, wherein in step d) the size layer precursor is at least partially cured to provide a size layer.

7. The method of claim 1, further comprising after step d) disposing a size layer precursor comprising a second curable binder precursor over the make layer, magnetizable particles, and non-magnetizable particles, and at least partially curing the size layer precursor to provide a size layer.

8. The method of claim 1, wherein passing the mixture of magnetizable particles and non-magnetizable particles through at least a portion of the applied magnetic field comprises dropping the mixture of magnetizable particles and non-magnetizable particles through at least a portion of the applied magnetic field.

9. The method of claim 1, wherein the non-magnetizable particles comprise grinding aid particles.

10. The method of claim 1, wherein the magnetizable particles comprise grinding aid particles.

11. The method of claim 1, wherein the non-magnetizable particles comprise abrasive particles having a Mohs hardness of at least 4.

12. The method of claim 1, wherein the magnetizable particles comprise abrasive particles having a Mohs hardness of at least 4.

13. The method of claim 12, wherein the abrasive particles comprise alumina.

14. The method of claim 11, wherein the abrasive particles are shaped as triangular platelets.

15. The method of claim 11, wherein the abrasive particles are precisely-shaped.

* * * * *